US011235192B1

(12) United States Patent
Thomas

(10) Patent No.: US 11,235,192 B1
(45) Date of Patent: Feb. 1, 2022

(54) EXERCISE APPARATUS

(71) Applicant: Zhair Giovanni Thomas, Phillipsburg (NL)

(72) Inventor: Zhair Giovanni Thomas, Phillipsburg (NL)

( * ) Notice: Subject to any disclaimer, the term of this patent is extended or adjusted under 35 U.S.C. 154(b) by 39 days.

(21) Appl. No.: 16/840,912

(22) Filed: Apr. 6, 2020

Related U.S. Application Data

(60) Provisional application No. 62/832,378, filed on Apr. 11, 2019.

(51) Int. Cl.
*A63B 21/078* (2006.01)

(52) U.S. Cl.
CPC ..... *A63B 21/078* (2013.01)

(58) Field of Classification Search
CPC ..... A63B 21/072–0783
See application file for complete search history.

(56) References Cited

U.S. PATENT DOCUMENTS 7,549,950 B1 * 6/2009 Lundquist ..... A63B 21/078 482/101
8,500,608 B1 * 8/2013 Bonomi ..... A63B 21/4045 482/101
10,391,377 B1 * 8/2019 Sorin ..... A63B 22/0046
2014/0256517 A1 * 9/2014 Poppinga ..... A63B 21/0783 482/104
2015/0306443 A1 * 10/2015 Bruni, Jr. ..... A63B 21/0724 482/104
2018/0272176 A1 * 9/2018 Aasa ..... A63B 21/0626
2018/0318635 A1 * 11/2018 Lee ..... A63B 21/156

* cited by examiner

*Primary Examiner* — Jennifer Robertson
(74) *Attorney, Agent, or Firm* — Gulf Coast Intellectual Property Group

(57) ABSTRACT

An exercise apparatus that is configured to be operably coupled to a conventional support frame having support poles providing vertical movement of the exercise apparatus. The exercise apparatus includes a bar member wherein the bar member has an engagement portion for use by a user when executing an exercise using the bar member. The engagement portion is provided in alternate styles. The bar member includes a pair of bar support members that are opposedly located on the bar member at opposite ends of the engagement portion. The exercise apparatus further includes a first connection assembly and a second connection assembly that are configured to operably couple with the first bar support member and second bar support member. Pin assemblies are provided to releasably secure the first bar support member and second bar support member with the first connection assembly and second connection assembly.

10 Claims, 4 Drawing Sheets

EXERCISE APPARATUS

PRIORITY UNDER 35 U.S.C Section 119(e) & 37 C.F.R. Section 1.78

This nonprovisional application claims priority based upon the following prior U.S. Provisional Patent Application entitled: Exercise Apparatus, Application No. 62/832,378 filed Apr. 11, 2019, in the name of Zhair Thomas, which is hereby incorporated by reference for all purposes.

FIELD OF THE INVENTION

The present invention relates generally to fitness equipment, more specifically but not by way of limitation, a weight lifting exercise apparatus that is configured to provide a user the ability to efficiently change the style of lift bar wherein the exercise apparatus of the present invention is configured to be utilized with free weights.

BACKGROUND

As is known in the art, there are numerous types of exercise equipment and fitness routines available to individuals for use during an exercise program. The health and fitness industry has been proliferated with technology and equipment over the last several decades. Recreational athletes to professional athletes utilize specific equipment and routines to achieve their fitness objectives. Fitness is typically broken down into two categories of cardiovascular training and resistance training. Cardiovascular training is executed with the objective to achieve an increased heart rate for a certain period of time. Cardiovascular routines can be performed either with or without equipment and are focused on increasing the endurance of the participant. Resistance training involves the use of weights, bands or some type of force that is opposed to the movement of the user. Resistance training is executed with the objective of targeting a particular muscle group and increase the strength thereof.

There are numerous types of resistance exercise equipment such as but not limited to universal stack weight style and free weight style. Free weights are quite popular for some athletes and the use thereof includes a bar. There are many types of weight lifting bars that are designed to assist the user engage the weight lifting bar and weights in a specific manner so as to improve the desired results. Weight lifting bar styles can include but are not limited to a standard bar, trap bar, squat bar and curl bar. During utilization of any of the aforementioned, a user must exchange weights on the bars and if a user desires to change bars must place weights on a different style bar for alternate exercises. The time required to change weights and bars is time consuming and inconvenient.

It is intended within the scope of the present invention to provide an exercise apparatus that is configured to provide a user a technique of changing weight lifting bars without tools and wherein the present invention is configured to movably couple to weight lifting support posts configured to guide vertical movement.

SUMMARY OF THE INVENTION

It is the object of the present invention to provide an exercise apparatus that is configured to facilitate a resistance exercise for a user thereof wherein the apparatus is configured to include a plurality of different styles of weight lifting bars.

Another object of the present invention is to provide a weightlifting apparatus that is configured to vertically traverse opposing support pole members wherein the weightlifting apparatus includes a first connection assembly and a second connection assembly.

A further object of the present invention is to provide an exercise apparatus that is configured to facilitate a resistance exercise for a user thereof wherein the first connection assembly and second connection assembly are slidably coupled to support pole members.

Still another object of the present invention is to provide a weightlifting apparatus that is configured to vertically traverse opposing support pole members wherein the weight lifting bar of the present invention is operably coupled to a bar support member at opposing ends of the weight lifting bar.

An additional object of the present invention is to provide an exercise apparatus that is configured to facilitate a resistance exercise for a user thereof wherein the bar support members are configured to operably coupled with the first connection assembly and second connection assembly.

Yet a further object of the present invention is to provide a weightlifting apparatus that is configured to vertically traverse opposing support pole members wherein the bar support members are releasably secured within the first bar receiving member and second bar receiving member with locking pins.

Another object of the present invention is to provide an exercise apparatus that is configured to facilitate a resistance exercise for a user thereof wherein each bar of the present invention is adjustable to accommodate alternate widths of the frame with which the weight lift bar is engaged.

An alternate object of the present invention is to provide a weightlifting apparatus that is configured to vertically traverse opposing support pole members wherein the first connection assembly and second connection assembly include an upper and lower support members that are perpendicular to the body of the bar support members.

Still a further object of the present invention is to provide an exercise apparatus that is configured to facilitate a resistance exercise for a user thereof wherein a void is present the upper and lower support members of the first connection assembly and second connection assembly wherein the void is configured to have the bar support members engage therewith.

An additional object of the present invention is to provide a weightlifting apparatus that is configured to vertically traverse opposing support pole members that further includes a first safety latch and a second safety latch configured to maintain a desired position of the weight lifting bar.

A further object of the present invention is to provide an exercise apparatus that is configured to facilitate a resistance exercise for a user thereof wherein the opposing ends of the weight lifting bars of the present invention are operable to be coupled with the first connection assembly and second connection assembly.

An alternative objective of the present invention is to provide a weightlifting apparatus that is configured to vertically traverse opposing support pole members wherein the first connection assembly and second connection assembly include an aperture journaled therethrough so as to facilitate traversal along a support pole.

Another object of the present invention is to provide an exercise apparatus that is configured to facilitate a resistance exercise for a user thereof wherein the locking pin of the present invention is configured with a first pin and a second pin that are parallel and operable to be journaled into apertures of the upper and lower support members of the first connection assembly and second connection assembly.

Yet a further object of the present invention is to provide a weightlifting apparatus that is configured to vertically traverse opposing support pole members wherein the present invention is configured to accommodate up to seven hundred pounds to include the weight of the weight lifting bar.

Another object of the present invention is to provide an exercise apparatus that is configured to facilitate a resistance exercise for a user thereof wherein the bar support members are releasably secured to the first connection assembly and second connection assembly with an additional horizontally oriented pin.

To the accomplishment of the above and related objects the present invention may be embodied in the form illustrated in the accompanying drawings. Attention is called to the fact that the drawings are illustrative only. Variations are contemplated as being a part of the present invention, limited only by the scope of the claims.

BRIEF DESCRIPTION OF THE DRAWINGS

A more complete understanding of the present invention may be had by reference to the following Detailed Description and appended claims when taken in conjunction with the accompanying Drawings wherein:

DETAILED DESCRIPTION

Figure 1:
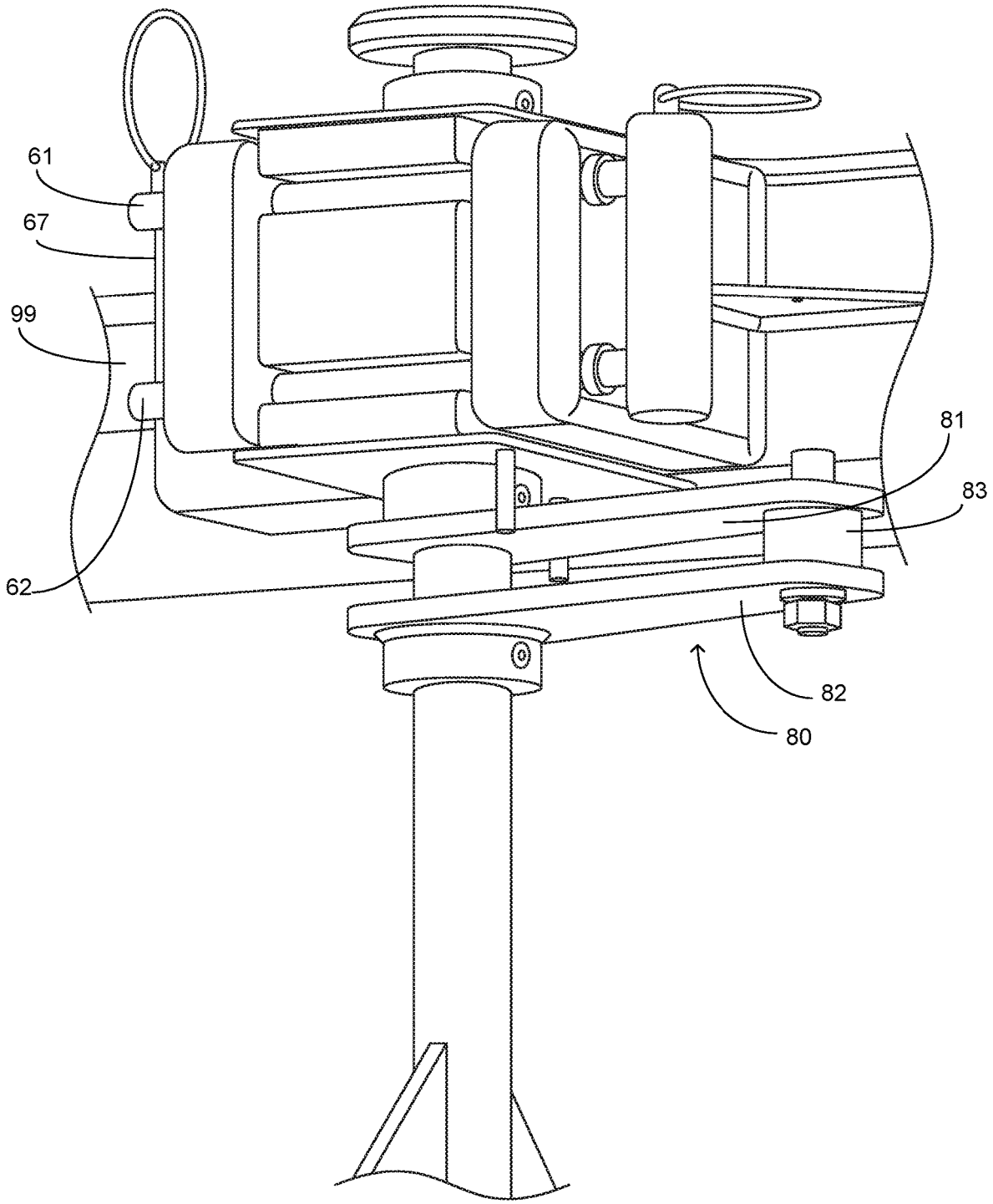
FIG. 1 is a detailed view of the connection assembly of the present invention.

Referring now to the drawings submitted herewith, wherein various elements depicted therein are not necessarily drawn to scale and wherein through the views and figures like elements are referenced with identical reference numerals, there is illustrated an exercise apparatus 100 constructed according to the principles of the present invention.

An embodiment of the present invention is discussed herein with reference to the figures submitted herewith. Those skilled in the art will understand that the detailed description herein with respect to these figures is for explanatory purposes and that it is contemplated within the scope of the present invention that alternative embodiments are plausible. By way of example but not by way of limitation, those having skill in the art in light of the present teachings of the present invention will recognize a plurality of alternate and suitable approaches dependent upon the needs of the particular application to implement the functionality of any given detail described herein, beyond that of the particular implementation choices in the embodiment described herein. Various modifications and embodiments are within the scope of the present invention.

It is to be further understood that the present invention is not limited to the particular methodology, materials, uses and applications described herein, as these may vary. Furthermore, it is also to be understood that the terminology used herein is used for the purpose of describing particular embodiments only, and is not intended to limit the scope of the present invention. It must be noted that as used herein and in the claims, the singular forms "a", "an" and "the" include the plural reference unless the context clearly dictates otherwise. Thus, for example, a reference to "an element" is a reference to one or more elements and includes equivalents thereof known to those skilled in the art. All conjunctions used are to be understood in the most inclusive sense possible. Thus, the word "or" should be understood as having the definition of a logical "or" rather than that of a logical "exclusive or" unless the context clearly necessitates otherwise. Structures described herein are to be understood also to refer to functional equivalents of such structures. Language that may be construed to express approximation should be so understood unless the context clearly dictates otherwise.

References to "one embodiment", "an embodiment", "exemplary embodiments", and the like may indicate that the embodiment(s) of the invention so described may include a particular feature, structure or characteristic, but not every embodiment necessarily includes the particular feature, structure or characteristic.

Figure 2:
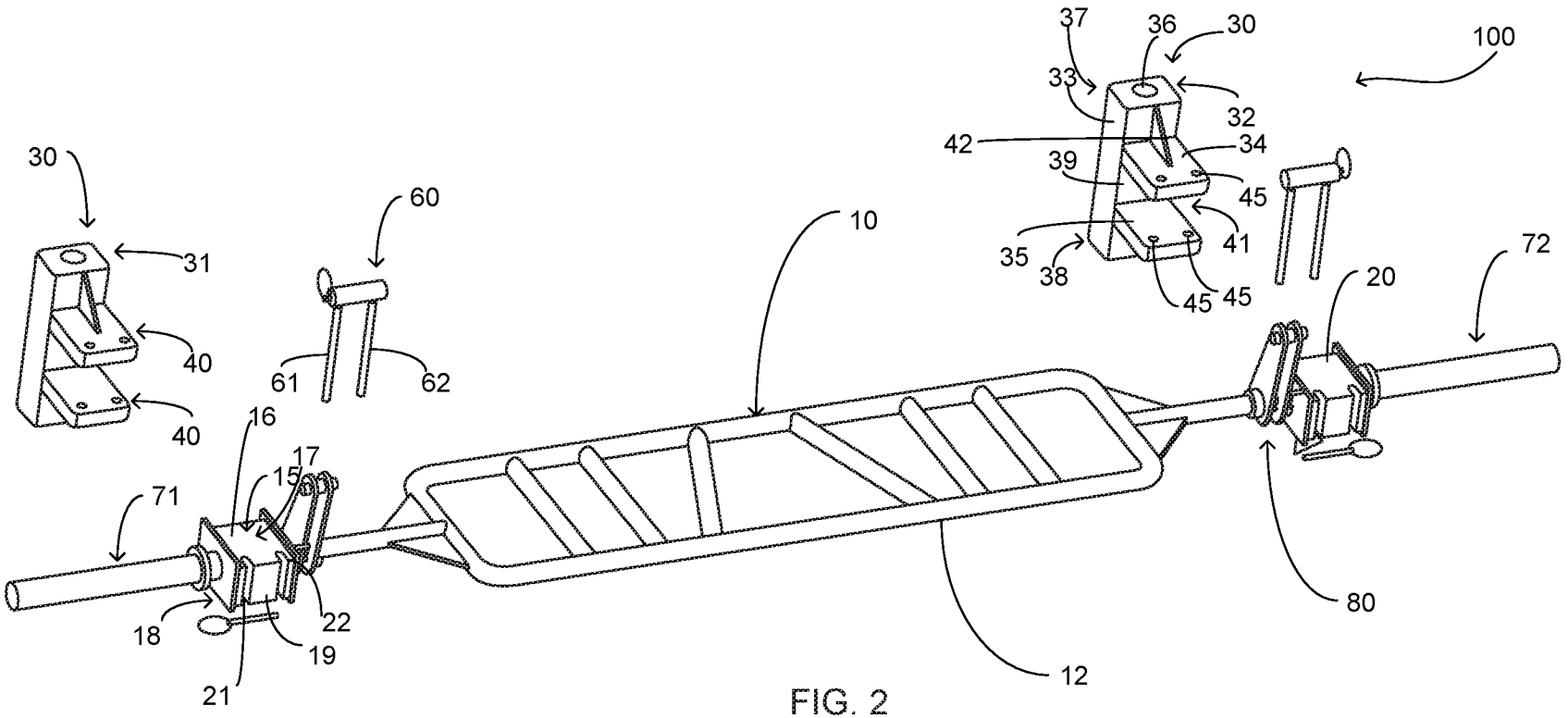
FIG. 2 is a disassembled perspective view of the present invention coupled to an exemplary exercise bar.
Figure 3:
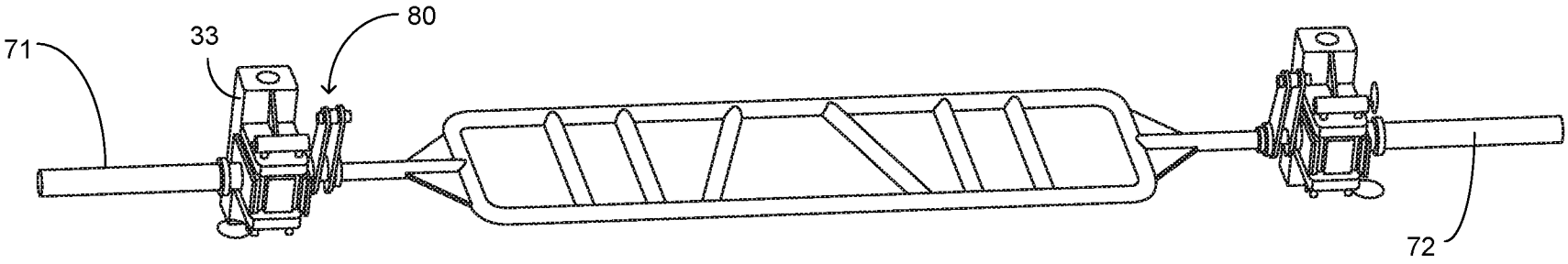
FIG. 3 is an assembled perspective view of the present invention coupled to an exemplary exercise bar.
Figure 4:
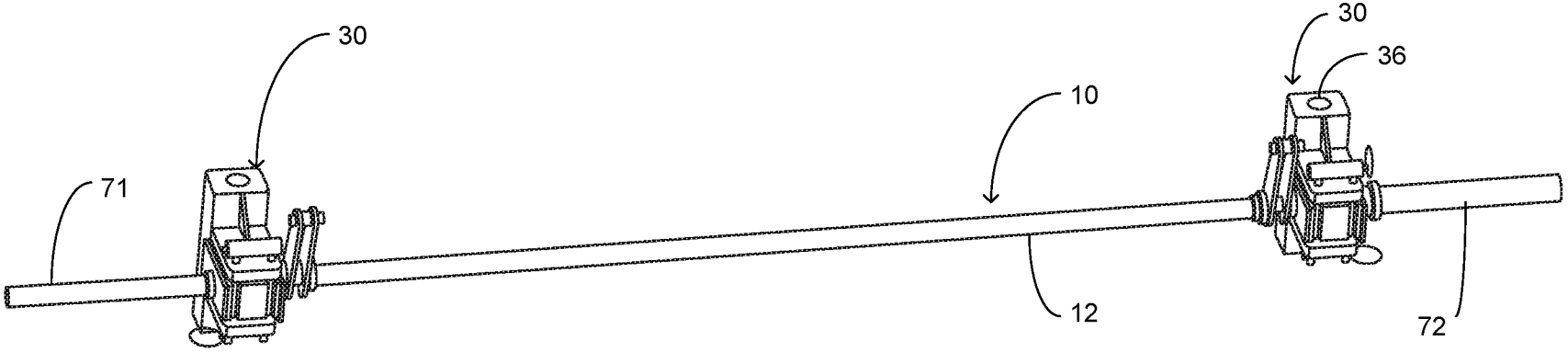
FIG. 4 is an assembled perspective view of the present invention coupled to an exemplary exercise bar.
Figure 5:
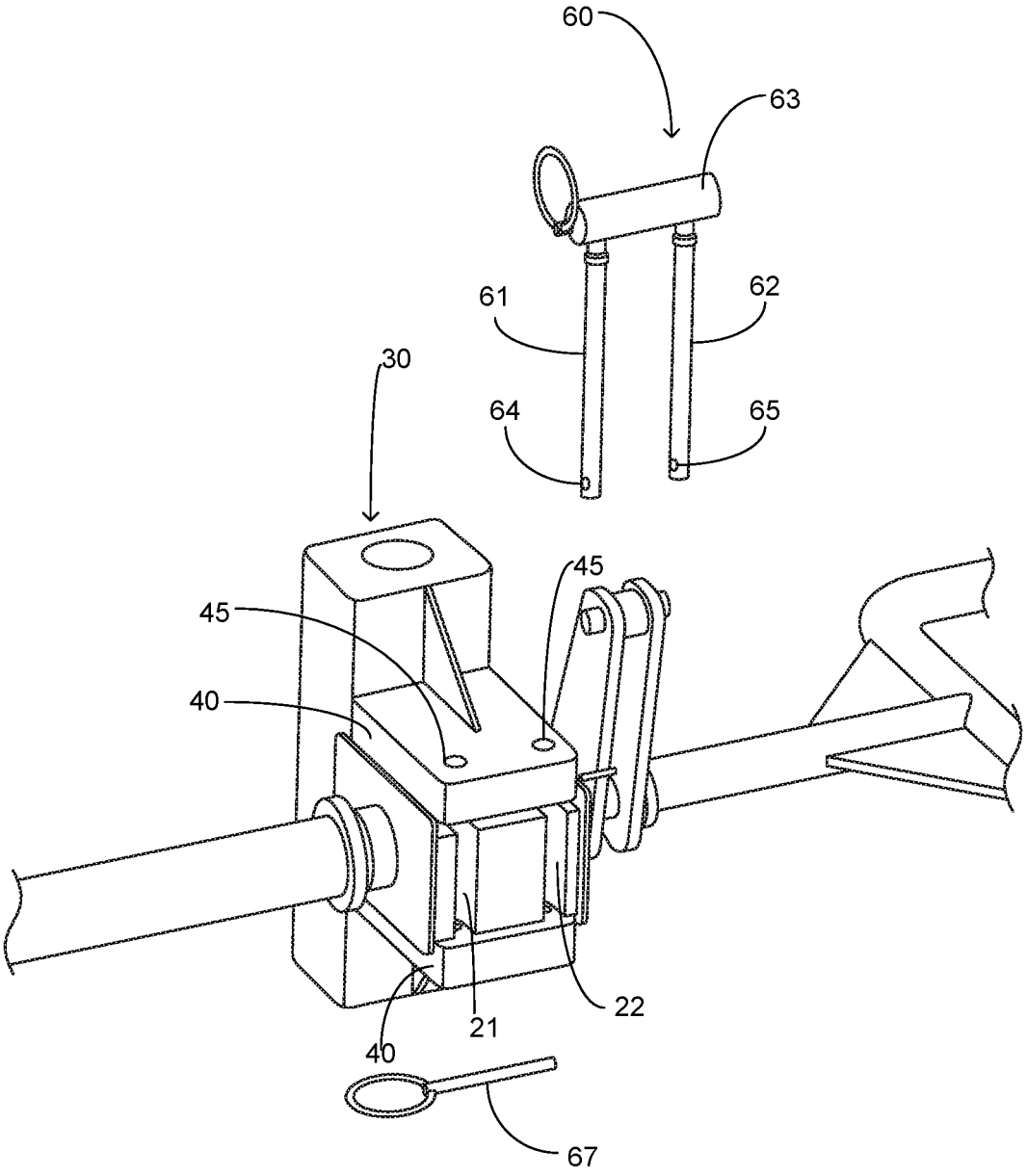
FIG. 5 is a detailed view of the connection assembly of the present invention.

Now referring to the Figures submitted as a part hereof, the exercise apparatus 100 includes a bar member 10 having an engagement portion 12 configured to be operable to be utilized by a user for engagement with the exercise apparatus 100. It should be understood within the scope of the present invention that the bar member 10 is provided with alternate engagement portions 12 in order to facilitate execution of various different exercises. FIG. 2 and FIG. 4 herein illustrate exemplary embodiments of the engagement portion 12 but it should be understood within the scope of the present invention that the engagement portion 12 of the bar member 10 could be configured in various alternate manners.

The bar member 10 includes a first bar support member 15 and a second bar support member 20. The first bar support member 15 and second bar support member 20 are distally located on opposite ends of the engagement portion 12 of the bar member 10. The first bar support member 15 and second bar support member 20 are identically constructed and as such the foregoing detailed description of the first bar support member 15 should be understood to apply to the second bar support member 20. The first bar support member 15 includes a body member 16 being manufactured of solid metal and is generally rectangular in shape. The body member 16 includes upper surface 17, lower surface 18 and front surface 19. The upper surface 17 and lower surface 18 are planar in manner and configured to operably couple with the support members 40 of the connection assembly 30 as is further discussed herein. The front surface 19 has grooves 21,22 formed therein utilizing suitable techniques. The grooves 21,22 extend completely intermediate the upper surface 17 and lower surface 18. The grooves 21,22 are spaced apart and are configured to operably receive pins 61,62 of the pin assembly 60. The bar member 10 includes opposing weight receiving portions 71,72 contiguously formed on opposing ends thereof. The weight receiving portions 71,72 are designed to receive and retain conventional free weights (not illustrated herein) and are of sufficient length to accommodate a plurality thereof.

The exercise apparatus 100 includes a first connection assembly 31 and a second connection assembly 32. The connection assemblies 30 are configured to operably couple to a support pole 99 of an exercise frame wherein the exercise frame is a conventional vertical frame that permits vertical travel of the connection assemblies 30 therealong. The first connection assembly 31 and second connection assembly 32 are configured to operably couple with the first bar support member 15 and second bar support member 20 respectively. The first connection assembly 31 and second connection assembly 32 are identically constructed and as such the foregoing discussion of the second connection assembly 32 should be understood to apply to the first connection assembly 31. The second connection assembly 32 includes base member 33, an upper support member 34 and a lower support member 35. The base member 33, upper support member 34 and lower support member 35 are integrally formed utilizing suitable techniques such as but not limited to casting or welding. The base member 33 has a passage 36 formed therethrough that extends intermediate the upper end 37 and lower end 38 wherein the passage 36 has openings at each end. The passage 36 has support pole 99 journaled therethrough and is slidably engaged therewith. The passage 36 engagement with the support pole 99 provides the operable coupling to ensure the second connection assembly 32 maintains an operable coupling with the support pole 99 during utilization of the exercise apparatus 100.

The upper support member 34 and lower support member 35 extend outward from the front surface 39 and are perpendicular thereto. The upper support member 34 and lower support member 35 have a void 41 therebetween. The void 41 is configured to operably couple with the body member 16 of the corresponding bar support member. The upper support member 34 further includes support brace 42 that is configured to provide structural support of the upper support member 34. While not illustrated herein, it is contemplated within the scope of the present invention that the lower support member 35 could have a similar support structure. The upper support member 34 and lower support member 35 further include apertures 45 formed therein. The apertures 45 are axially aligned and are configured to receive pins 61, 62 therethrough. Ensuing placement of the first bar support member 15 and second bar support member 20 into respective connection assemblies 30, the pin assembly 60 is operably coupled wherein the pins 61,62 journal through apertures 45 and releasably secure the first bar support member 15 and second bar support member 20. The aforementioned provides a rapid change of styles of bar members 10 as desired to execute alternate exercise routines.

The pin assembly 60 includes pins 61, 62 that are parallel and extend downward from the pin support member 63. The pins 61,62 are spaced so as to mateably couple with apertures 45. Pins 61, 62 have holes 64,65 bored therethrough wherein the holes 64,65 are distally located from the pin support member 63. Holes 64,65 are configured to have locking pin 67 operably coupled thereto ensuing placement of the pin assembly 60 so as to ensure the maintenance of the position of the pin assembly 60 and as such the bar member 10 with the connection assemblies 30.

Opposedly located on the engagement portion 12 of the bar member 10 are support arm members 80. Support arm members 80 includes a first segment 81 and a second segment 82 that are movably coupled utilizing fastener 83. The second segment 82 is movably coupled to the first segment 81 so as to provide desired functional movement of the engagement portion 12 of the bar member 10 during execution of an exercise. The support arm members 80 further facilitate the ability for the bar member 10 to accommodate alternate widths of support pole to which the exercise apparatus 100 is operably coupled. It is contemplated within the scope of the present invention that the exercise apparatus 100 could employ alternate elements in addition to or in conjunction with the support arm members 80 to provide desired movement of the engagement portion 12 and the ability to accommodate alternate widths of support poles. While not particularly illustrated herein, it is contemplated within the scope of the present invention that the exercise apparatus 100 could incorporate safety latches or similar elements that are configured to maintain the position of the exercise apparatus 100 on support pole 99 in order to inhibit unwanted movement thereof.

In the preceding detailed description, reference has been made to the accompanying drawings that form a part hereof, and in which are shown by way of illustration specific embodiments in which the invention may be practiced. These embodiments, and certain variants thereof, have been described in sufficient detail to enable those skilled in the art to practice the invention. It is to be understood that other suitable embodiments may be utilized and that logical changes may be made without departing from the spirit or scope of the invention. The description may omit certain information known to those skilled in the art. The preceding description is, therefore, not intended to be limited to the specific forms set forth herein, but on the contrary, it is intended to cover such alternatives, modifications, and equivalents, as can be reasonably included within the spirit and scope of the invention.

What is claimed is:

1. An exercise apparatus that is operable to provide a plurality of styles of bar members that can be interchanged for use thereof wherein the exercise apparatus comprises:

a bar member, said bar member having an engagement portion, said engagement portion configured to be engaged by a user of the exercise apparatus during execution of an exercise, said engagement portion having a first end and a second end, wherein said bar member further includes weight receiving portions, said weight receiving portions being distally located on said bar member;

a first bar support member, said first bar support member being located at said first end of said engagement portion;

a second bar support member, said second bar support member being located at said second end of said engagement portion;

a first connection assembly, said first connection assembly being slidably coupled to a support pole, wherein said first connection assembly further includes an upper support member and a lower support member, said upper support member and said lower support member having a void therebetween;

a second connection assembly, said second connection assembly being slidably coupled to a support pole, and wherein said second connection assembly further includes an upper support member and a lower support member, said upper support member and said lower support member of said second connection assembly having a void therebetween;

a first pin assembly and a second pin assembly, said first pin assembly configured to releasably secure said first bar support member and said first connection assembly ensuing operable coupling thereof, said second pin assembly configured to releasably secure said second bar support member and said second connection assembly ensuing operable coupling thereof; and wherein the first bar support member is releasably secured to said first connection assembly and said second bar support member is releasably secured to said second connection assembly so as to facilitate exchange of the bar member and wherein said first bar support member is configured to operably engage the void intermediate the upper support member and lower support member when the first bar support member and first connection assembly are operably coupled and wherein said second bar support member is configured to operably engage the void intermediate the upper support member and lower support member of said second connection assembly when the second bar support member and second connection assembly are operably coupled.

2. An exercise apparatus configured to be operably coupled with a support frame having opposing support poles wherein the exercise apparatus is configured to provide exchange of a bar member thereof wherein the exercise apparatus comprises:

a bar member, said bar member having a first end and a second end, said bar member having an engagement portion, said engagement portion being intermediate said first end and said second end of said bar member, said engagement portion having a first end and a second end, said bar member having weight receiving portions proximate said first end and said second end of said bar member, said weight receiving portions configured to receive weight plates thereon;

a first bar support member, said first bar support member being proximate said first end of said engagement portion and being operably coupled with said bar member, said first bar support member having a body member, said body member having an upper surface, a lower surface and a front surface, wherein the front surface of said body member of said first bar support member has two grooves formed therein;

a second bar support member, said second bar support member being proximate said second end of said engagement portion and being operably coupled with said bar member, said second bar support member having a body member, said body member of said second bar support member having an upper surface, a lower surface and a front surface, wherein the front surface of said body member of said second bar support member has two grooves formed therein;

a first connection assembly, said first connection assembly being slidably coupled to one of the opposing support poles of the support frame, said first connection assembly having a base member, said base member having a front surface, said base member having a hollow passage therethrough wherein the hollow passage provides slidable engagement of the first connection assembly with the one of the opposing support poles;

a second connection assembly, said second connection assembly being slidably coupled to one of the opposing support poles of the support frame, said second connection assembly having a base member, said base member of the second connection assembly having a front surface, said base member of said second connection assembly having a hollow passage therethrough wherein the hollow passage of the base member of the second connection assembly provides slidable engagement of the second connection assembly with one of the opposing support poles; and wherein the first connection assembly and second connection assembly provide an ability to interchange the bar member, wherein said first connection assembly includes an upper support member and a lower support member, said upper support member and said lower support member being secured to said front surface of the base member of the first connection assembly, said upper support member and said lower support member extending outward from said front surface and having a void therebetween, said upper support member and said lower support member being parallel and wherein said second connection assembly includes an upper support member and a lower support member, said upper support member and said lower support member of said second connection assembly being secured to said front surface of the base member of the second connection assembly, said upper support member and said lower support member of said second connection assembly extending outward from said front surface and having a void therebetween, said upper support member and said lower support member of said second connection assembly being parallel.

3. The exercise apparatus as recited in claim 2, and further including a first pin assembly and a second pin assembly, said first pin assembly configured to secure said first bar member and said first connection assembly ensuing operable coupling thereof.

4. The exercise apparatus as recited in claim 3, wherein said second pin assembly is configured to secure said second bar member and said second connection assembly ensuing operable coupling thereof.

5. The exercise apparatus as recited in claim 4, wherein said upper support member and said lower support member of said first connection assembly further include apertures formed therein, said apertures being axially aligned, said apertures being configured to receive a portion of said first pin assembly.

6. The exercise apparatus as recited in claim 5, wherein said upper support member and said lower support member of said second connection assembly further include apertures formed therein, said apertures of said upper support member and said lower support member of said second connection assembly being axially aligned, said apertures of said upper support member and said lower support member of said second connection assembly being configured to receive a portion of said second pin assembly.

7. An exercise apparatus configured to be operably coupled with a support frame having opposing support poles wherein the exercise apparatus is configured to provide exchange of a bar member thereof wherein the exercise apparatus comprises:

a bar member, said bar member having a first end and a second end, said bar member having an engagement portion, said engagement portion being intermediate said first end and said second end of said bar member, said engagement portion having a first end and a second end, said bar member having weight receiving portions proximate said first end and said second end of said bar member, said weight receiving portions configured to receive weight plates thereon;

a first bar support member, said first bar support member being proximate said first end of said engagement portion and being operably coupled with said bar member, said first bar support member having a body member, said body member having an upper surface, a lower surface and a front surface, wherein the front surface has two grooves formed therein;

a second bar support member, said second bar support member being proximate said second end of said engagement portion and being operably coupled with said bar member, said second bar support member having a body member, said body member of said second bar support member having an upper surface, a lower surface and a front surface, wherein the front surface of the body member of the second bar support member said two grooves formed therein;

a first connection assembly, said first connection assembly being slidably coupled to one of the opposing support poles of the support frame, said first connection assembly having a base member, said base member having a front surface, said base member having a hollow passage therethrough wherein the hollow passage provides slidable engagement of the first connection assembly with the one of the opposing support poles, wherein said first connection assembly includes an upper support member and a lower support member, said upper support member and said lower support member being secured to said front surface of the base member of the first connection assembly, said upper support member and said lower support member extending outward from said front surface and having a void therebetween, said upper support member and said lower support member being parallel;

a second connection assembly, said second connection assembly being slidably coupled to one of the opposing support poles of the support frame, said second connection assembly having a base member, said base member of the second connection assembly having a front surface, said base member of said second connection assembly having a hollow passage therethrough wherein the hollow passage of the base member of the second connection assembly provides slidable engagement of the second connection assembly with one of the opposing support poles, wherein said second connection assembly includes an upper support member and a lower support member, said upper support member and said lower support member of said second connection assembly being secured to said front surface of the base member of the second connection assembly, said upper support member and said lower support member of said second connection assembly extending outward from said front surface and having a void therebetween, said upper support member and said lower support member of said second connection assembly being parallel;

a first pin assembly and a second pin assembly, said first pin assembly and said second pin assembly being comprised of a pin support member and a first pin and a second pin, said first pin and said second pin extending downward from said pin support member, said first pin and said second pin being parallel and having a space therebetween so as to facilitate the engagement thereof with the two grooves on the front surface of the body member of the first bar support member and the two grooves on the front surface of the second bar support member, said first pin assembly configured to secure said first bar member and said first connection assembly ensuing operable coupling thereof; and wherein the first connection assembly and second connection assembly operably engage the first bar support member and second bar support member so as to provide an ability to interchange the bar member.

8. The exercise apparatus as recited in claim 7, wherein said upper support member and said lower support member of said second connection assembly further include apertures formed therein, said apertures of said upper support member and said lower support member of said second connection assembly being axially aligned, said apertures of said upper support member and said lower support member of said second connection assembly being configured to receive a the first pin and second pin of the second pin assembly.

9. The exercise apparatus as recited in claim 8, wherein said upper support member and said lower support member of said first connection assembly further include apertures formed therein, said apertures of said upper support member and said lower support member of said first connection assembly being axially aligned, said apertures of said upper support member and said lower support member of said first connection assembly being configured to receive a the first pin and second pin of the first pin assembly.

10. The exercise apparatus as recited in claim 9, wherein the first pin and second pin of the first pin assembly and second pin assembly include holes, said holes being distal to said pin support member, said holes configured to receive a locking pin therethrough.

* * * * *